United States Patent [19]

Leonard et al.

[11] Patent Number: 4,603,327

[45] Date of Patent: Jul. 29, 1986

[54] GARMENT WITH FASTENER ALARM

[76] Inventors: Obie P. Leonard, 5200 Bryce, Fort Worth, Tex. 76107; George C. Witte, 7027 Elmridge, Dallas, Tex. 75240

[21] Appl. No.: 560,229

[22] Filed: Dec. 12, 1983

[51] Int. Cl.[4] ..... G08B 23/00

[52] U.S. Cl. ..... 340/573; 340/590; 340/539; 340/686; 200/DIG. 2; 24/405; 24/381; 455/100

[58] Field of Search ..... 340/573, 590, 568, 539, 340/548, 686, 687, 571, 572; 2/2, 69; 24/405, 381; 200/DIG. 2; 455/100, 91, 115; 116/77, 85, 208, 306, 311

[56] References Cited

U.S. PATENT DOCUMENTS

| | | | |
|---|---|---|---|
| 2,285,083 | 6/1942 | Cover, Sr. | 455/100 |
| 3,440,635 | 4/1969 | Hull | 455/100 |
| 3,893,096 | 7/1975 | Tucci et al. | 340/571 |
| 4,041,394 | 8/1977 | Pate | 455/100 |
| 4,253,197 | 3/1981 | Posta | 2/69 |
| 4,274,077 | 6/1981 | Feiger | 340/568 |

*Primary Examiner*—Donnie L. Crosland
*Attorney, Agent, or Firm*—Robert A. Felsman

[57] ABSTRACT

A warning device particularly for use in a coverall worn by a person in a controlled environment warns if the person has unfastened the garment. The garment has fasteners such as a zipper for opening and closing the garment. A pair of electrical contacts are mounted in the zipper track for contact by the zipper head as the zipper head moves along the zipper track. The zipper head establishes continuity through the contacts as it is drawn past. This provides a signal to a transmitter mounted to the coveralls. The transmitter provides a radio frequency signal to a receiver located in a monitoring area. The receiver provides a warning upon reception of the signal.

7 Claims, 4 Drawing Figures

Fig. 1
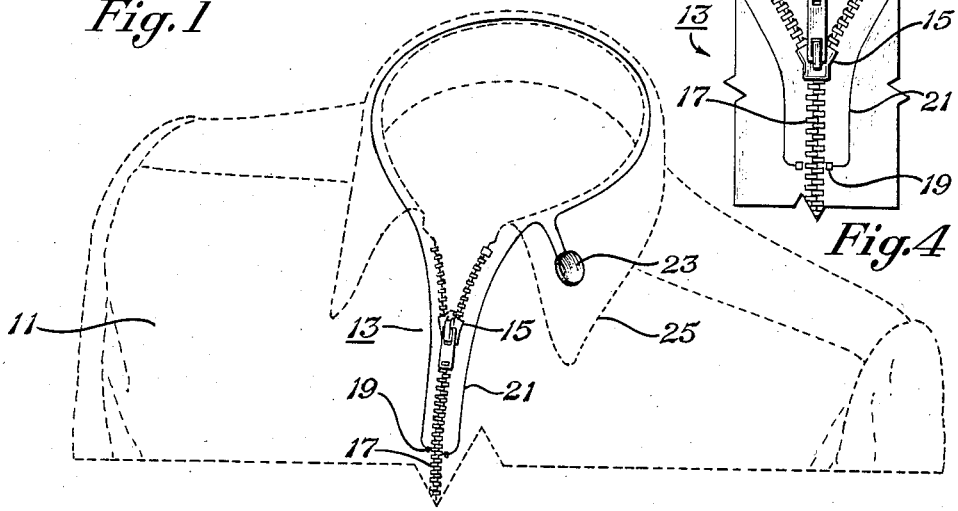
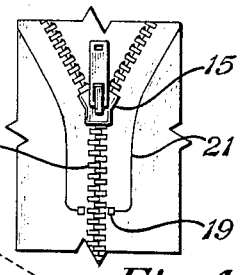
Fig. 4
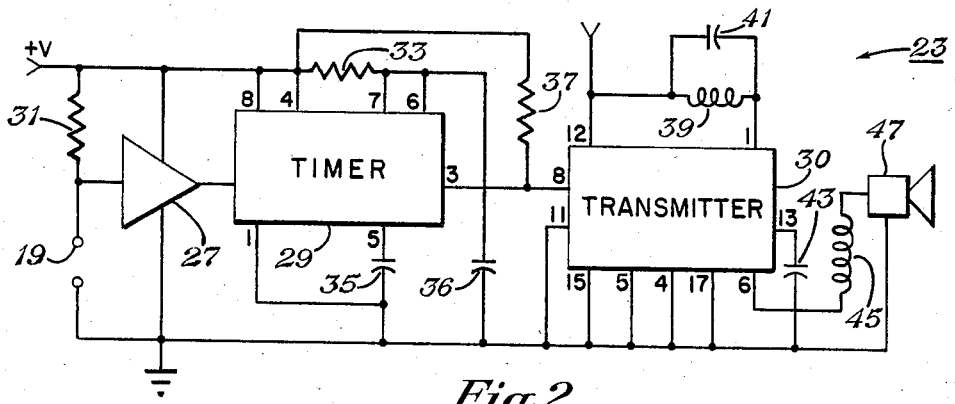
Fig. 2
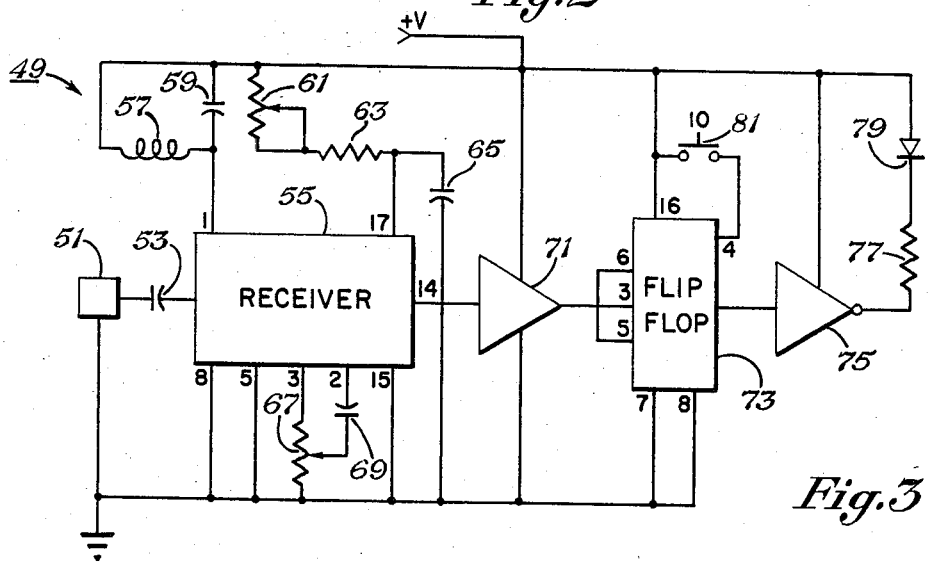
Fig. 3

GARMENT WITH FASTENER ALARM

BACKGROUND OF THE INVENTION

1. Field of the Invention

This invention relates in general to covering garments worn by workers in clean environments, and in particular to an alarm for warning a supervisor when the fastener of a garment is opened without authorization.

2. Description of the Prior Art

Many workers perform tasks in controlled, clean and sanitary environments. These workers are normally required to wear a protective, sanitized garment or coverall to protect the environment from contamination. Opening of the garment in a controlled environment may contaminate the environment, damaging the product and possibly subjecting the employer to fines by health inspectors, such as in the food processing industry. For example, in the dairy industry, protective clothing is required in the areas where the cows are being milked. It is not uncommon for a worker to partially unzip his garment for various reasons, despite well known rules. Detecting a partially opened protective garment is not easy unless a supervisor continually watches the employees. This is expensive and time consuming. There are no means known to applicants for detecting if a garment is being unzipped other than periodic checks by an inspector.

SUMMARY OF THE INVENTION

In this invention, means are provided for detecting when the fasteners or closure means of a garment is not in a fully closed position. This includes a signal means carried by the garment for providing a warning to a person in a remote location upon indication that the garment is not closed. Preferably, the signaling device is a radio frequency transmitter which transmits a signal to a receiver. Opening of the fasteners actuates the transmitter to provide the signal to the supervisor. The signal will remain at the supervisor's monitoring station until reset.

BRIEF DESCRIPTION OF THE DRAWINGS

FIG. 1 is a partial perspective view of a coverall having a signaling means constructed in accordance with this invention.

FIG. 2 is an electrical schematic view of the transmitter circuit of the signaling means of FIG. 1.

FIG. 3 is an electrical schematic of the receiver unit for receiving the signal generated by the transmitter of FIG. 1.

FIG. 4 is an enlarged, partial front view of the zipper of the garment of FIG. 1, showing the contacts for detecting when the zipper is being moved.

DESCRIPTION OF THE PREFERRED EMBODIMENT

Referring to FIG. 1, a covering garment or protective coverall 11 is shown in dotted lines. The garment 11 has a zipper 13 along the front. The zipper 13 serves as a closure or fastening means for securing the garment 11 on the worker.

Referring to FIG. 4, zipper 13 has a conventional metallic zipper head 15 that is drawn along a zipper track 17 which is secured within cloth that is sewn to the coverall 11. The zipper track 17 has teeth which are engaged when the zipper head 15 is pulled upwardly, and disengaged when the zipper head 15 is moved downwardly.

Zipper 13 differs from a conventional zipper in that it has a pair of electrical, metallic contacts 19 secured to it at or one or more points along the length of the zipper. Contacts 19 are secured to the cloth of the zipper 13 a slight distance to the side of each half of the zipper track 17. The contacts 19 are positioned to be contacted simultaneously by the zipper head 15 as the zipper head 15 is moved upward or downward past the contacts 19. Zipper head 15 provides an electrical conductive path between the two contacts 19 when it simultaneously engages the contacts 19. When the zipper head 15 is located above or below the contacts 19, the circuit will be open and the contacts 19 will not be in electrical contact with each other. Each contact 19 is secured to a wire 21 which leads to a transmitter assembly 23, as shown in FIG. 1. Transmitter assembly 23 is releasably fastened to a part of the garment 11, such as the collar 25.

Referring to FIG. 2, when the zipper head 15 provides a conductive path between the two contacts 19, circuit means will cause a radio frequency signal to be transmitted by the signal circuit 23. One of the contacts 19 is connected to ground, while the other contact 19 is connected to the input of an amplifier 27. Amplifier 27 is a contact debouncer and serves to eliminate the effects of mechanical contact bounce in case the contacts 19 open or close very rapidly. Amplifier 27 has its output connected to a timer circuit 29. Timer circuit 29 is a conventional circuit, preferably NE 555, which generates an electrical pulse of sufficient duration to actuate a transmitter means 30. Amplifier 27 is connected conventionally between a battery or positive voltage source and ground. One contact 19 is connected to the voltage source through a resistor 31. The timer circuit 29 is connected conventionally, having a resistor 33 connected between pin 4 and 7. A capacitor 35 is connected between pin 5 and ground. A capacitor 36 is connected between pin 6 and ground. A resistor 37 is connected between pin 4 and the input pin 8 of transmitter 30. The amplifier 27 and timer 29 serve as circuit means for actuating transmitter 30 when the voltage in the wires 21 changes. The circuit means and wires 21 and contacts 19 cooperate to serve as detector means for detecting when the zipper 13 is not adequately closed.

Transmitter 30 is also connected in a conventional manner. It has an inductor 39 connected between pins 1 and 12. A capacitor 41 is connected in parallel with the inductor 39. Pin 13 of the transmitter is connected to ground through a capacitor 43. The output pin 6 of the transmitter is connected through an inductor 45 to a transducer 47. Transmitter 30 is a conventional transmitter for generating a constant radio frequency signal of relatively low wattage. Preferably the transmitter is an LM 1812 chip.

The signal from transmitter 30 will be generated for the amount of time preset by the timer 29. The signal will be received by a remote alarm unit 49, which provides a warning signal of some type of a person monitoring the workers, such as a supervisor. As shown in FIG. 3, the alarm unit 49 includes a transducer or antenna 51 which receives the signal from the transmitter 30. Transducer 51 applies the signal through a capacitor 53 to a conventional receiver circuit 55. Receiver circuit 55 is connected in a conventional manner. Its pin 1 is connected through an inductor 57 to a positive voltage source. Pin 1 is also connected through a capacitor 59 to a voltage source. Its pin 2 is connected through a capacitor 69 to the wiper of a potentiometer 67. Potentiometer 67 is connected between ground and pin 3 of the receiver circuit 55. Pin 17 of receiver circuit 55 is connected through a potentiometer 61 and resistor 63 to the voltage source. Pin 17 is also connected to ground through capacitor 65. Receiver circuit 55 is preferably an LM 1812 receiver chip.

The output from pin 14 of the receiver circuit 55 leads to alarm means that includes an inverter 71. Inverter 71 inverts the signal received from the receiver and applies it to a flip flop 73. Flip flop 73 will hold the signal and apply it to an amplifier 75. Flip flop 73 is a conventional flip flop, preferably MC 14027. A low output on amplifier 75 indicates that a signal has been received by the receiver 55. The low output will allow a light emitting diode 79 to turn on, indicating that a signal has been received. Other warnings, such as an audible alarm could also be connected to the output of the driver amplifier 75. The diode 79 will remain on until the flip flop 73 is reset by depressing the reset switch 81. Reset switch 81 closes the circuit between pins 4 and 16 of the flip flop 73. Reset switch 81 and flip flop 73 serve as sustaining means for sustaining the warning until reset.

In operation, if desired, the workers could put on the garments for work in an area that is selected so that the signals would not cause a false alarm at the monitoring station. For example, the changing room could be located at a distance from the monitoring station farther than the transmitter will transmit. Also, if desired, the rest rooms could be located farther than the transmitter would normally transmit so as to avoid false alarms when the workers are using the rest room. The work stations, however, must be well within the range of the transmitter from the monitoring station. Also, the transmitter must not be constructed so that it could be disabled by the worker as by removing the battery. While working, if a worker unzips his zipper 13 to a point below the contacts 19, the zipper head 15 will close the contacts 19. This will provide a flow of current through resistor 31, which is amplified by amplifier 27 and applied to the timer 29. The timer 29 will provide a signal of selected duration to the transmitter 30. The transmitter 30 will transmit a signal for the duration selected by the timer 29. The duration of the signal sent by the transmitter 30 will be independent of the amount of time that the zipper head 15 momentarily engages the contacts 19.

At the monitoring station, the receiver 55 will amplify the signal and apply it to a inverter 71, which sets flip flop 73. The flip flop 73 will provide a sustained output to an amplifier 75 which causes the alarm means or LED 79 to come on. The LED 79 will remain on until the person monitoring the workers learns of the warning and resets the flip flop 73 by pressing the reset switch 81. The supervisor then may take action by confronting the worker that has moved the zipper 13 from the fully closed position. Transmitters 30 of different frequencies and receiver circuits 55 tuned to different frequencies could be used to determine which worker of numerous workers has actuated the alarm.

The invention has significant advantages. The warning means is a simple and effective device for notifying when workers in a clean environment have moved the fasteners from a closed position. The circuits are conventional and inexpensive to manufacture. The transmitter assembly could be made removable from the garment for cleaning.

While the invention has been shown in only one of its forms, it should be apparent to those skilled in the art that it is not so limited but susceptible to various changes without departing from the scope of the invention.

We claim:

1. A warning system for remote detection of potential environmental contamination by deviation of personnel from clothing standards in a controlled environment process, the system comprising:

a garment adapted to clothe selected portions of the body of a person to protect the environment from contamination;

closure means in the garment for securing the garment on the person;

signal means carried by the garment and connected with the closure means for providing a signal upon indication that the closure means is not adequately closed while the person is in the controlled environment;

a battery powered transmitter means connected with the signal means:

a pair of leads extending from the warning means to the closure means, each lead having contact means positioned for electrical contact with each other by opening and closing the closure means;

circuit means for actuating the transmitter means should a change in voltage occur in the leads due to opening of the closure means;

the closure, signal, transmitter and circuit means being embedded in the garment to prevent tampering and deactivation;

a remote receiver means in communication with the transmitter means to warn of potential environmental contamination.

2. A warning system for remote detection of potential environmental contamination by deviation of personnel from clothing standards in a controlled environment process, the system comprising:

a garment adapted to clothe selected portions of the body of a person to protect the environment from contamination;

closure means on the garment for securing the garment on the person;

signal means carried by the garment for providing a signal upon indication that the closure means is not adequately closed while the person is in the controlled environment;

transmitter means for providing a signal;

a pair of wires connected to a source of voltage and extending from the transmitter means to the closure means, each wire having contact means positioned for electrical contact with each other by manipulation of the closure means;

circuit means for actuating the transmitter means should a change in voltage occur in the wires due to manipulation of the closure means;

the closure means, signal means, transmitter means, pair of wires and circuit means being embedded in the garment to prevent tampering and deactivation;

a remote receiver means in communication with the transmitter means to warn of potential environmental contamination.

3. A warning system for remote detection of potential environmental contamination by deviation of personnel from clothing standards in a controlled environment process, the system comprising:

a garment adapted to clothe selected portions of the body of a person to protect the environment from contamination;

closure means to secure the garment to the person;

a battery powered transmitter means carried by the garment for providing a radio frequency signal;

detector means carried by the garment for actuating the transmitter means upon indication that the closure means is not adequately closed while the person is in the controlled environment;

receiver means remotely located from the person for receiving the signal;

remote alarm means connected to the receiver means for providing an alarm warning when a signal is received by the receiver means;

a pair of wires connected to a source of voltage and extending from the transmitter means to the closure means, each wire having electrical contact means for electrically contacting each other through electrical contact with the closure means;

circuit means for actuating the transmitter means should a change in voltage occur in the wires due to movement of the closure means;

the closure means, transmitter means, detector means, receiver means, pair of wires and circuit means being embedded in the garment to prevent tampering such that the warning system is always active while the wearer is in the controlled environment.

4. A warning system for remote detection of potential environmental contamination by deviation of personnel from clothing standards in a controlled environment process, the system comprising:

a garment adapted to clothe selected portions of the body of a person to protect the environment from contamination;

closure means to secure the garment to the person;

a battery powered transmitter means carried by the garment for providing a radio frequency signal;

detector means carried by the garment for actuating the transmitter means upon indication that the closure means is not adequately closed while the person is in the controlled environment;

receiver means remotely located from the person for receiving the signal;

remote alarm means connected to the receiver means for providing an alarm warning when a signal is received by the receiver means;

a pair of wires connected to a source of voltage and extending from the transmitter means to the closure means, each wire having an electrical contact means spaced-apart from the electrical contact means of the other wire and positioned for making electrical contact with each other when the closure means is being opened and closed;

circuit means for actuating the transmitter means when electrical contact between the wires occurs;

the closure means, transmitter means, detector means, receiver means, pair of wires, electrical contact means, source of voltage and circuit means being embedded in the garment to prevent tampering by the person in the controlled environment.

5. In a zipper with a zipper track that is selectively opened and closed by metallic zipper head, the improvement comprising:

a pair of electrical contacts secured adjacent the zipper track and positioned to make electrical continuity with each other through the zipper head as the zipper head is drawn past the electrical contacts; and warning means electrically connected to the electrical contacts for providing a signal if electrical continuity occurs, to warn that the zipper is not adequately closed.

6. The improvement according to claim 5 wherein the warning means comprises:

transmitter means for providing a radio frequency signal; and circuit means for actuating the transmitter means should electrical continuity between the electrical contacts occur;

the improvement further comprising receiver means remotely located from the person for receiving the radio frequency signal; and alarm means connected to the receiver means for providing an alarm warning.

7. The improvement according to claim 6 wherein the alarm means has sustaining means for sustaining the alarm warning until manually reset.

* * * * *